US007975780B2

(12) United States Patent
Siher et al.

(10) Patent No.: US 7,975,780 B2
(45) Date of Patent: Jul. 12, 2011

(54) ADJUSTABLE DOWNHOLE MOTORS AND METHODS FOR USE

(75) Inventors: Joachim Siher, Cheltenham (GB); Guy J. Rushton, Malmesbury (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 26 days.

(21) Appl. No.: 12/360,612

(22) Filed: Jan. 27, 2009

(65) Prior Publication Data

US 2010/0187009 A1 Jul. 29, 2010

(51) Int. Cl.
*E21B 4/00* (2006.01)

(52) U.S. Cl. ..... 175/57; 175/107

(58) Field of Classification Search ..... 175/57, 175/101, 103, 107

See application file for complete search history.

(56) References Cited

U.S. PATENT DOCUMENTS

| | | | | |
|---|---|---|---|---|
| 3,725,668 | A | 4/1973 | Padgitt | |
| 4,100,981 | A | 7/1978 | Chaffin | |
| 5,097,708 | A | 3/1992 | Kobayashi et al. | |
| 5,113,953 | A | 5/1992 | Noble et al. | |
| 5,265,682 | A | 11/1993 | Russell et al. | |
| 5,520,255 | A | 5/1996 | Barr et al. | |
| 5,553,678 | A | 9/1996 | Barr et al. | |
| 5,553,679 | A | 9/1996 | Thorp et al. | |
| 5,582,259 | A | 12/1996 | Barr et al. | |
| 5,603,385 | A | 2/1997 | Colebrook et al. | |
| 5,673,763 | A | 10/1997 | Thorp et al. | |
| 5,685,379 | A | 11/1997 | Barr et al. | |
| 5,695,015 | A | 12/1997 | Barr et al. | |
| 5,706,905 | A | 1/1998 | Barr et al. | |
| 5,778,992 | A | 7/1998 | Fuller et al. | |
| 5,785,509 | A * | 7/1998 | Harris et al. | 418/11 |
| 5,803,185 | A | 9/1998 | Barr et al. | |
| 5,817,937 | A | 10/1998 | Beshoory et al. | |
| 5,970,787 | A | 10/1999 | Wignall | |
| 5,971,085 | A | 10/1999 | Colebrook et al. | |
| 6,089,332 | A | 7/2000 | Barr et al. | |
| 6,092,610 | A | 7/2000 | Kosmala et al. | |
| 6,158,529 | A | 12/2000 | Dorel | |
| 6,244,361 | B1 | 6/2001 | Comeau et al. | |
| 6,364,034 | B1 | 4/2002 | Schoeffler | |
| 6,394,193 | B1 | 5/2002 | Askew | |
| 6,860,104 | B2 | 3/2005 | Reinertsen et al. | |
| 7,226,379 | B2 | 6/2007 | Ibamoto et al. | |
| 7,234,543 | B2 | 6/2007 | Schaaf | |

(Continued)

OTHER PUBLICATIONS

G. Robello Samuel, "Downhole Drilling Tools: Theory & Practice for Engineers & Students" 288-333 (2007).

(Continued)

*Primary Examiner* — William P Neuder
(74) *Attorney, Agent, or Firm* — Jeremy Welch

(57) ABSTRACT

The present invention relates to systems and methods for controlling downhole motors and drilling systems incorporating such systems and methods. One aspect of the invention provides a downhole drilling system including: a downhole motor, a transmission coupled to the downhole motor, and a drill bit coupled to the transmission. Another aspect of the invention provides a method of drilling a borehole in a subsurface formation including the steps of: providing a drill string including a downhole motor, a transmission coupled to the downhole motor, and a drill bit coupled to the transmission; and rotating the drill string while flowing a fluid through the drill string to the downhole motor, thereby powering the downhole motor, thereby rotating the transmission and the drill bit.

21 Claims, 5 Drawing Sheets

U.S. PATENT DOCUMENTS

| | | | | |
|---|---|---|---|---|
| 7,331,897 | B2 | 2/2008 | Ibamoto et al. | |
| 7,510,031 | B2 * | 3/2009 | Russell et al. | 175/170 |
| 2001/0052428 | A1 | 12/2001 | Larronde et al. | |
| 2002/0011359 | A1 | 1/2002 | Webb et al. | |
| 2002/0074167 | A1 | 6/2002 | Plop | |
| 2005/0050974 | A1 | 3/2005 | Ibamoto et al. | |
| 2005/0162154 | A1 | 7/2005 | Mol et al. | |
| 2006/0254819 | A1 * | 11/2006 | Moriarty | 175/40 |
| 2006/0254824 | A1 | 11/2006 | Horst et al. | |
| 2007/0072726 | A1 | 3/2007 | Dell'Eva et al. | |
| 2007/0154341 | A1 | 7/2007 | Saenger | |
| 2007/0191186 | A1 | 8/2007 | Bothe et al. | |
| 2007/0232424 | A1 | 10/2007 | Nishida | |
| 2009/0050370 | A1 * | 2/2009 | Peters | 175/45 |

OTHER PUBLICATIONS

"Standard Handbook of Petroleum & Natural Gas Engineering" 4-276-4-299 (William C. Lyons & Gary J. Plisga eds. 2006).

1 Yakov A . Gelfgat et al., "Advanced Drilling Solutions: Lessons from the FSU" 154-72 (2003).

Robert O. Parmley, "Machine Devices & Components" 13-14 (2005).

Daniel J. Klingenberg, "Magnetorheology: Applications & Challenges", 47(2) AlChE J. 246-49 (Feb. 2001).

* cited by examiner 306
308
310a
310b
310c
310d
314a
314b
314c
314d
304
316
312
300
302
318

1st Stage
2nd Stage
3rd Stage
4th Stage
5th Stage

ADJUSTABLE DOWNHOLE MOTORS AND METHODS FOR USE

FIELD OF THE INVENTION

The present invention relates to systems and methods for controlling downhole motors and drilling systems incorporating such systems and methods.

BACKGROUND OF THE INVENTION

Mud motors are powerful generators used in drilling operations to turn a drill bit, generate electricity, and the like. The speed and torque produced by a mud motor is affected by the design of the mud motor and the flow of mud (drilling fluid) into the mud motor. Motors can stall and suffer speed variations as a consequence of loading and drill string motion. Accordingly, there is a need for devices and methods for controlling the operation of a mud motor.

SUMMARY OF THE INVENTION

The present invention relates to systems and methods for controlling downhole motors and drilling systems incorporating such systems and methods.

One aspect of the invention provides a downhole drilling system including: a downhole motor, a transmission coupled to the downhole motor, and a drill bit coupled to the transmission.

This aspect can have a variety of features. The transmission can be a multi-ratio transmission. The transmission can be a continuously variable transmission. The transmission can be a fluid transmission. The fluid transmission can be a magnetorheological fluid transmission.

The downhole motor can include: a stator having a proximal end and a distal end, and a rotor having a proximal end and a distal end. The rotor is received coaxially within the stator. The transmission can include: a plurality of rotor windows extending through the rotor and a mandrel having a proximal end and a distal end. The mandrel is received coaxially within the rotor. The mandrel has a plurality of mandrel windows. The mandrel is movable to selectively align one or more of the mandrel windows with one or more of the rotor windows, thereby allowing the flow of fluid from between the stator and rotor into the mandrel.

The rotor can include an orifice for receiving fluid from the proximal end of the stator. The downhole motor can include a spring received within the rotor for countering distal movement of the mandrel. The spring can be an extension spring located at the proximal end of the rotor. The spring can be a compression spring located at the distal end of the rotor. The downhole motor can be fed at the proximal end of the stator by pressure from a drill string. The distal end of the mandrel can be vented to downstream pressure.

The mandrel can be initially configured to allow flow of fluid through a most proximal rotor window. The mandrel can be configured to only allow fluid flow through one of the plurality of rotor windows. The downhole motor can include a downhole actuator for controlling the position of the mandrel. The mandrel can be configured for discrete actuation, wherein at least one mandrel window is completely aligned with at least one rotor window. The downhole motor can include a plurality of springs, each spring configured to hold the mandrel so that at least one of the mandrel windows is aligned with at least one of the rotor windows. The fluid can be mud.

Another aspect of the invention provides a downhole motor including: a stator having a proximal end and a distal end, a rotor having a proximal end and a distal end, and a mandrel having a proximal end and a distal end. The rotor is received coaxially within the stator. The stator has a plurality of rotor windows. The mandrel is received coaxially within the rotor. The mandrel has a plurality of mandrel windows. The mandrel is movable to selectively align one or more of the mandrel windows with one or more of the rotor windows, thereby allowing the flow of fluid from between the stator and rotor into the mandrel.

Another aspect of the invention provides a method of drilling a borehole in a subsurface formation including the steps of: providing a drill string including a downhole motor, a transmission coupled to the downhole motor, and a drill bit coupled to the transmission; and rotating the drill string while flowing a fluid through the drill string to the downhole motor, thereby powering the downhole motor, thereby rotating the transmission and the drill bit.

This aspect can have a variety of features. The downhole motor can include: a stator having a proximal end and a distal end, and a rotor having a proximal end and a distal end. The rotor is received coaxially within the stator. The transmission can include: a plurality of rotor windows extending through the rotor and a mandrel having a proximal end and a distal end. The mandrel is received coaxially within the rotor. The mandrel can have a plurality of mandrel windows. The mandrel is movable to selectively align one or more of the mandrel windows with one or more of the rotor windows, thereby allowing the flow of fluid from between the stator and rotor into the mandrel. The method can include: selectively actuating the mandrel to adjust the torque applied to the bit. Selectively actuating the mandrel allows for drilling at the optimum speed.

Another aspect of the invention provides a bottom hole assembly including: a motor; a first shaft coupled to the motor; a transmission coupled to the first shaft; and a second shaft coupled to the gearbox.

This aspect can have a variety of features. The bottom hole assembly can include a speed sensor for monitoring the rotational speed of the first shaft. The bottom hole assembly can include a controller for actuating the transmission to maintain a desired rotational speed. The transmission can be a compound planetary gear system. The transmission can include magneto-rheological fluid seals.

Another embodiment of the invention provides a method of drilling a borehole in a subsurface formation. The method includes: providing a drill string coupled to a bottom hole assembly including a motor, a first shaft coupled to the motor, a transmission coupled to the first shaft, a second shaft coupled to the gearbox, and a bit coupled the second shaft; rotating the drill string while flowing a fluid through the drill string to the motor, thereby powering the motor; and selectively actuating the transmission to maintain a desired rotational speed of the first shaft.

This aspect can have a variety of features. The step of actuating the transmission can be performed electrically, electro-mechanically, fluidically, or mechanically.

DESCRIPTION OF THE DRAWINGS

For a fuller understanding of the nature and desired objects of the present invention, reference is made to the following detailed description taken in conjunction with the accompanying drawing figures wherein like reference characters denote corresponding parts throughout the several views and wherein.

DETAILED DESCRIPTION OF THE INVENTION

The present invention relates to systems and methods for controlling downhole motors and drilling systems incorporating such systems and methods. Various embodiments of the invention can be used in a wellsite system.

Wellsite System

Figure 1:
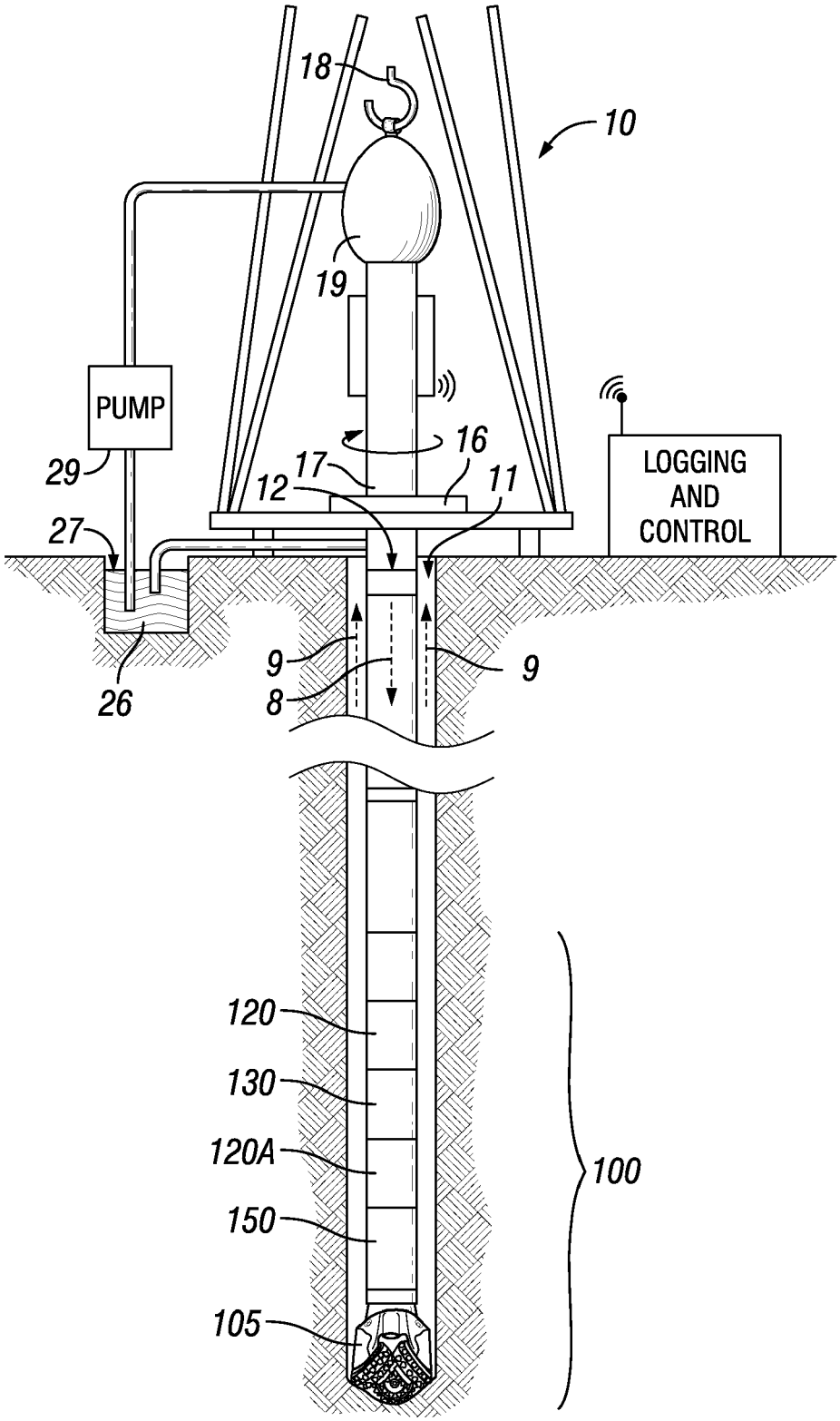
FIG. 1 illustrates a wellsite system in which the present invention can be employed according to one embodiment of the invention.

FIG. 1 illustrates a wellsite system in which the present invention can be employed. The wellsite can be onshore or offshore. In this exemplary system, a borehole 11 is formed in subsurface formations by rotary drilling in a manner that is well known. Embodiments of the invention can also use directional drilling, as will be described hereinafter.

A drill string 12 is suspended within the borehole 11 and has a bottom hole assembly 100 which includes a drill bit 105 at its lower end. The surface system includes platform and derrick assembly 10 positioned over the borehole 11, the assembly 10 including a rotary table 16, kelly 17, hook 18 and rotary swivel 19. The drill string 12 is rotated by the rotary table 16, energized by means not shown, which engages the kelly 17 at the upper end of the drill string 12. The drill string 12 is suspended from a hook 18, attached to a traveling block (also not shown), through the kelly 17 and a rotary swivel 19 which permits rotation of the drill string 12 relative to the hook. As is well known, a top drive system could alternatively be used.

In the example of this embodiment, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 105, and then circulates upwardly through the annulus region between the outside of the drill string 12 and the wall of the borehole, as indicated by the directional arrows 9. In this well known manner, the drilling fluid lubricates the drill bit 105 and carries formation cuttings up to the surface as it is returned to the pit 27 for recirculation.

The bottom hole assembly 100 of the illustrated embodiment includes a logging-while-drilling (LWD) module 120, a measuring-while-drilling (MWD) module 130, a roto-steerable system and motor, and drill bit 105.

The LWD module 120 is housed in a special type of drill collar, as is known in the art, and can contain one or a plurality of known types of logging tools. It will also be understood that more than one LWD and/or MWD module can be employed, e.g. as represented at 120A. (References, throughout, to a module at the position of 120 can alternatively mean a module at the position of 120A as well.) The LWD module includes capabilities for measuring, processing, and storing information, as well as for communicating with the surface equipment. In the present embodiment, the LWD module includes a pressure measuring device.

The MWD module 130 is also housed in a special type of drill collar, as is known in the art, and can contain one or more devices for measuring characteristics of the drill string 12 and drill bit 105. The MWD tool further includes an apparatus (not shown) for generating electrical power to the downhole system. This may typically include a mud turbine generator (also known as a "mud motor") powered by the flow of the drilling fluid, it being understood that other power and/or battery systems may be employed. In the present embodiment, the MWD module includes one or more of the following types of measuring devices: a weight-on-bit measuring device, a torque measuring device, a vibration measuring device, a shock measuring device, a stick slip measuring device, a direction measuring device, and an inclination measuring device.

A particularly advantageous use of the system hereof is in conjunction with controlled steering or "directional drilling." In this embodiment, a roto-steerable subsystem 150 (FIG. 1) is provided. Directional drilling is the intentional deviation of the wellbore from the path it would naturally take. In other words, directional drilling is the steering of the drill string 12 so that it travels in a desired direction.

Directional drilling is, for example, advantageous in offshore drilling because it enables many wells to be drilled from a single platform. Directional drilling also enables horizontal drilling through a reservoir. Horizontal drilling enables a longer length of the wellbore to traverse the reservoir, which increases the production rate from the well.

A directional drilling system may also be used in vertical drilling operation as well. Often the drill bit 105 will veer off of a planned drilling trajectory because of the unpredictable nature of the formations being penetrated or the varying forces that the drill bit 105 experiences. When such a deviation occurs, a directional drilling system may be used to put the drill bit 105 back on course.

A known method of directional drilling includes the use of a rotary steerable system ("RSS"). In an RSS, the drill string 12 is rotated from the surface, and downhole devices cause the drill bit 105 to drill in the desired direction. Rotating the drill string 12 greatly reduces the occurrences of the drill string 12 getting hung up or stuck during drilling. Rotary steerable drilling systems for drilling deviated boreholes into the earth may be generally classified as either "point-the-bit" systems or "push-the-bit" systems.

In the point-the-bit system, the axis of rotation of the drill bit 105 is deviated from the local axis of the bottom hole assembly in the general direction of the new hole. The hole is propagated in accordance with the customary three-point geometry defined by upper and lower stabilizer touch points and the drill bit 105. The angle of deviation of the drill bit axis coupled with a finite distance between the drill bit 105 and lower stabilizer results in the non-collinear condition required for a curve to be generated. There are many ways in which this may be achieved including a fixed bend at a point in the bottom hole assembly close to the lower stabilizer or a flexure of the drill bit drive shaft distributed between the upper and lower stabilizer. In its idealized form, the drill bit 105 is not required to cut sideways because the bit axis is continually rotated in the direction of the curved hole. Examples of point-the-bit type rotary steerable systems, and how they operate are described in U.S. Patent Application Publication Nos. 2002/0011359; 2001/0052428 and U.S. Pat. Nos. 6,394,193; 6,364,034; 6,244,361; 6,158,529; 6,092,610; and 5,113,953.

In the push-the-bit rotary steerable system there is usually no specially identified mechanism to deviate the bit axis from the local bottom hole assembly axis; instead, the requisite non-collinear condition is achieved by causing either or both of the upper or lower stabilizers to apply an eccentric force or displacement in a direction that is preferentially orientated with respect to the direction of hole propagation. Again, there are many ways in which this may be achieved, including non-rotating (with respect to the hole) eccentric stabilizers (displacement based approaches) and eccentric actuators that apply force to the drill bit 105 in the desired steering direction. Again, steering is achieved by creating non co-linearity between the drill bit 105 and at least two other touch points. In its idealized form the drill bit 105 is required to cut side ways in order to generate a curved hole. Examples of push-the-bit type rotary steerable systems, and how they operate are described in U.S. Pat. Nos. 5,265,682; 5,553,678; 5,803,185; 5,695,015; 5,685,379; 5,706,905; 5,553,679; 5,673,763; 5,520,255; 5,603,385; 5,582,259; 5,778,992; 5,971,085; and 6,089,332.

Downhole Drilling System

Figure 2:
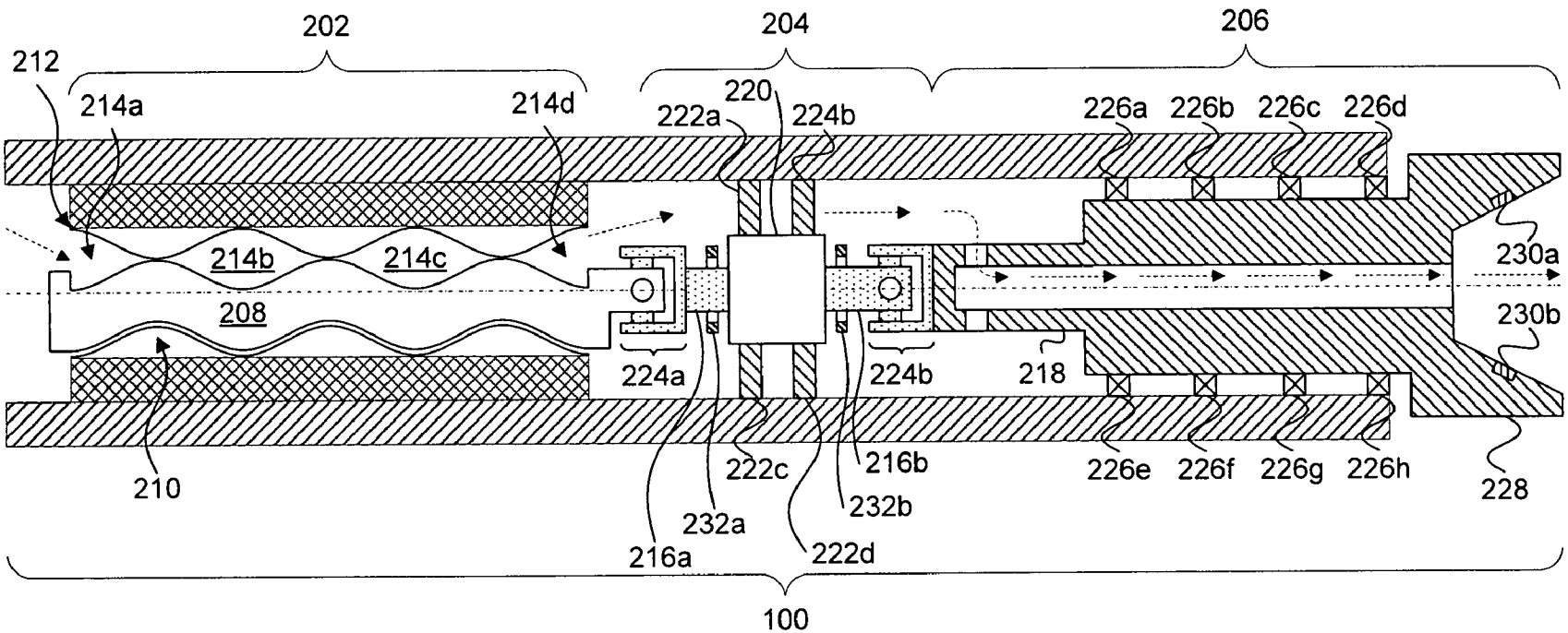
FIG. 2 illustrates a bottom hole assembly in which the present invention can be employed according to one embodiment of the invention.

Referring to FIG. 2, a bottom hole assembly 100 is provided including a downhole motor 202, a shaft section 204, and a rotating drill bit section 206.

Downhole motor 202 can be any of a number of now known or later developed downhole motors (also known as "mud motors"). Such devices include turbine motors, positive displacement motors, Moineau-type positive displacement motors, and the like. A Moineau-type positive displacement motor is depicted in FIG. 2. Mud motors are described in a number of publications such as G. Robello Samuel, *Downhole Drilling Tools: Theory & Practice for Engineers & Students* 288-333 (2007); *Standard Handbook of Petroleum & Natural Gas Engineering* 4-276-4-299 (William C. Lyons & Gary J. Plisga eds. 2006); and 1 Yakov A. Gelfgat et al., *Advanced Drilling Solutions: Lessons from the FSU* 154-72 (2003).

Generally, a downhole motor 202 consists of a rotor 208 and a stator 210. During drilling, high pressure fluid is pumped through the drill string 12 into the top end 212 of the downhole motor 202 to fill first set of cavities 214*a*. The pressure differential across adjacent cavities 214*a* and 214*b* forces rotor 208 to turn. As this happens, adjacent cavities are opened allowing fluid to progress through the downhole motor 202.

The rotor 208 is connected to shafts 216*a*, 216*b* to transmit the power generated by rotation of the rotor 208 to rotating drill bit shaft 218 via transmission 220. Transmission 220 can be supported with the bottom hole assembly 100 by mounts 222*a*, 222*b*, 222*c*, 222*d*. The rotor 208 and rotating drill bit shaft 218 can be connected to shaft 216 to by universal joints 224*a* and 224*b* to allow for flexibility. Rotating drill bit shaft 218 is supported within drill bottom hole assembly 100 by bearings 226*a*-*h*. Shaft 216 rotates drill bit shaft 218, which is connected to drill bit 228.

Fluid (depicted by dashed arrows) flows through downhole motor 202, around shafts 216*a*, 216*b*, and transmission 220 into drill string shaft 218, and out of the drill string shaft 218 adjacent to drill bit 228 to lubricate drill bit 228 during drilling.

Drill bit 228 can include one or more sensors 230*a*, 230*b* to measure drilling performance and/or drill bit location. Sensors 230*a*, 230*b* can include one more devices such as a three-axis accelerometer and/or magnetometer sensors to detect the inclination and azimuth of the drill bit 224. Sensors 230*a*, 230*b* can also provide formation characteristics or drilling dynamics data. Formation characteristics can include information about adjacent geologic formation gathered from ultrasound or nuclear imaging devices such as those discussed in U.S. Patent Publication No. 2007/0154341, the contents of which is hereby incorporated by reference herein. Drilling dynamics data can include measurements of the vibration, acceleration, velocity, and temperature of the bottom hole assembly 100 and/or drill bit 224.

Transmission 220 uses the principle of mechanical advantage to provide a speed-torque conversion from a higher speed motor 202 to a slower but more forceful output or vice-versa. Transmission 220 can be any type known by those of skill in the art. Such transmissions can include multi-ratio transmissions, continuously variable transmissions, and/or fluid transmissions. Multi-ratio transmissions utilize multiple gear combinations to achieve the desired torque/speed. Continuously variable transmissions (CVTs) provide an infinite number of effective gear ratios within a defined range. CVTs include variable-diameter pulley (VDP) transmissions (also known as "Reeves drives"), toroidal or roller-based transmissions, infinitely variable transmissions (IVTs), ratcheting CVTs, hydrostatic CVTs, variable toothed wheel transmissions, and cone CVTs, and radial roller CVTs. Fluid transmission technologies can include magnetorheological fluids (also known as "MR fluids" or "ferrofluids"). MR fluids can be incorporated into the transmissions described herein. For example, MR fluids can be selectively magnetized to function as a clutch in a multi-ratio transmission.

One or more speed sensors 232*a*, 232*b* can be included to measure the rotational speed of shafts 216*a*, 216*b*. Rotational speed sensors are described, for example, in U.S. Pat. Nos. 3,725,668 and 5,097,708, and U.S. Patent Publication Nos. 2005/0162154. A controller (not depicted) can be communicatively coupled with speed sensors 232*a*, 232*b*. The controller can control transmission 220 to achieve the desired speed and/or torque. Such a controller can be similar to transmission control units (TCUs) used in automatic transmissions for automobiles. Transmission control units are described in U.S. Pat. Nos. 7,226,379 and 7,331,897; and U.S. Patent Application Publication Nos. 2005/0050974; 2007/0072726; 2007/0191186; and 2007/0232434.

Integral Motor and Transmission

FIG. 3 depicts an integral motor/transmission 300. The integral motor/transmission 300 includes a rotor 302 and a stator 304. Rotor 302 includes a proximal end 306 and a distal end 308, as well as a plurality of rotor windows 310*a*, 310*b*, 310*c*, 310*d*. A mandrel 312 is received within the rotor 302 and includes a plurality of mandrel windows 314*a*, 314*b*, 314*c*, 314*d*. The mandrel 312 is movable to selectively align one or more mandrel windows 314 with one or more rotor windows 310 in order to allow the flow of fluid from between the stator 304 and the rotor 302 into the mandrel 312.

Figures 3A, 3B, 3C, 3D:
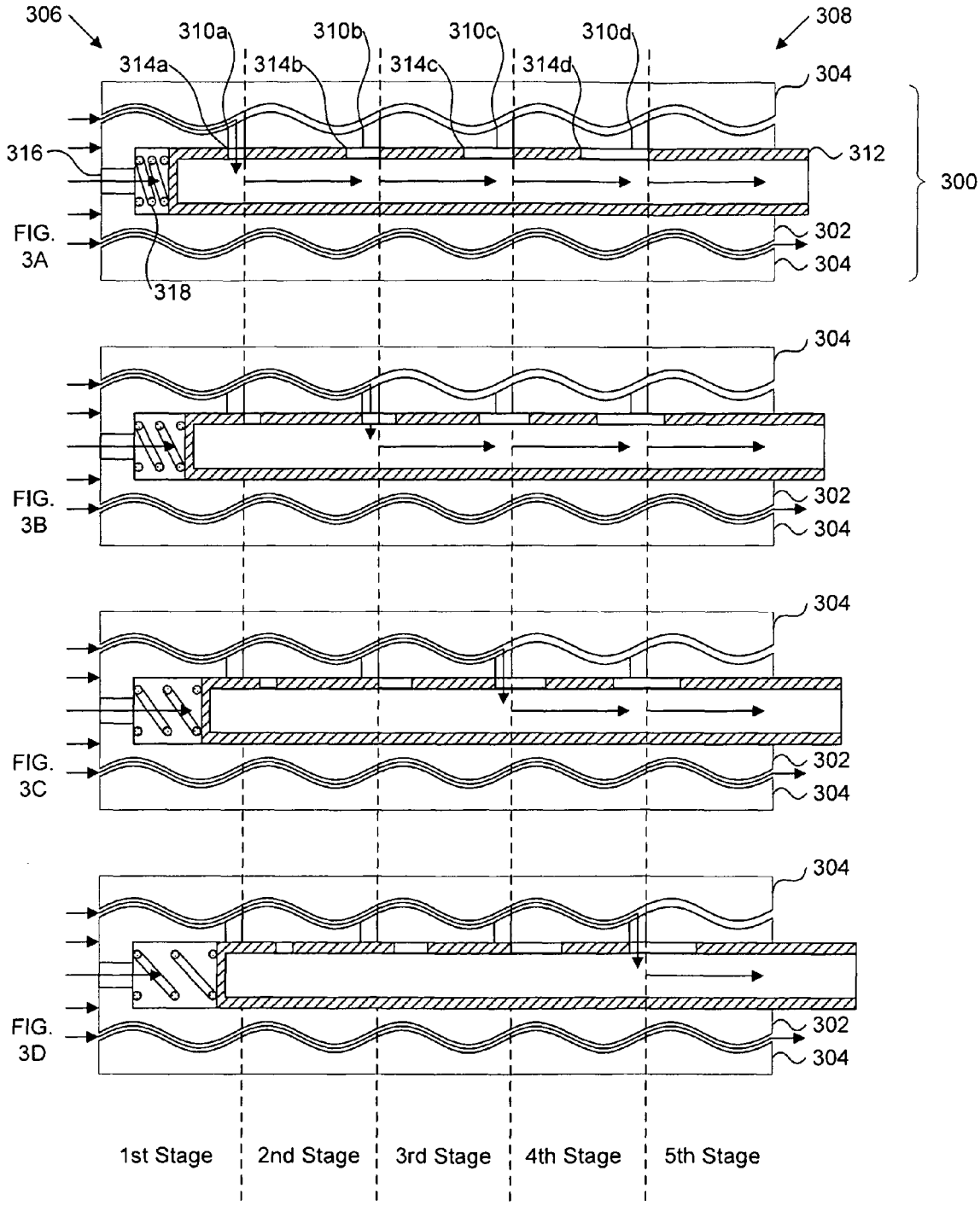
FIGS. 3A-3D illustrate the structure and operation of an integral motor/transmission according to one embodiment of the invention.

As depicted in FIG. 3A, the mandrel 312 is initially positioned such that each mandrel window 314 is in communication with a rotor window 310. Fluid (depicted by arrows) is vented through the first rotor window 310*a* to mandrel 312. As a result, the fluid only engages the first stage of the rotor 302. Referring to FIGS. 3B-3D, as the mandrel 312 is further depressed toward the distal end 308 of the rotor 302, one or more initial rotor windows 310 fall out of communication with mandrel windows 314, which causes additional stages of the rotor 302 to be engaged. At a certain point, the mandrel 312 can move such that none of the rotor windows 310 are in communication with a mandrel window 314, thereby engaging all five stages of rotor 302.

The rotor 302 can include an orifice 316 for receiving fluid from the proximal end 306 of the rotor. The fluid can be a fluid received through the drill string 12 such as mud. Increased pressure from the orifice 316 causes the mandrel 312 to move distally, thereby modulating the power produced by motor/transmission 300. Stated conversely, the power output of motor/transmission 300 can be modulated by changing the fluid pressure within the drill string 12.

Moreover, provided that uphole fluid pumps are set to a constant flow rate, the integral motor/transmission 300 can be substantially self-adjusting to maintain a constant rotational speed. As an increased load is applied to the motor/transmission 300, rotor 302 will experience greater resistance in turning. This increased resistance results in higher upstring fluid pressure and lower downstring fluid pressure. This pressure differential causes the mandrel 312 to displace distally closing one or more proximal rotor windows 310 and engaging another stage of the rotor 302 to provide the additionally torque required to maintain the desired rotational speed.

A spring 318 can be received within the rotor 302 to counter distal movement of the mandrel 312. The spring 318 can be an extension spring located at the proximal end of the mandrel 312 as depicted in FIGS. 3A-3D. Additionally or alternatively, the spring 318 can be a compression spring located at the distal end of the mandrel 312. In still other embodiments, a mandrel 312 can be coupled with a torsion spring by a linkage such a rope, chain, cable, and the like. The spring 318 can be replaced or supplemented by other means such as elastomers or hydraulic or pneumatic devices such as elastic bands, hydraulic springs, pneumatic springs, and the like.

The spring 318 can be engineered to produce desired mandrel movement over a range of pressures. For example, spring 318 can be configured to allow for linear movement of the mandrel 312 over a range of pressures. In another embodiment, the spring 318 can be configured to effect discrete movement of the mandrel 312 to align rotor windows 310 with mandrel windows 314. Discrete movement of the mandrel 312 may be preferable in some embodiments as partially-opened rotor windows 310 cause increased pressures and fluid velocities that result in increased wear of rotor 302 and mandrel 312.

To further prevent wear to rotor 302 and mandrel 312, these components can be fabricated from or coated with a wear-resistant material such as steel, "high speed steel", carbon steel, brass, copper, iron, polycrystalline diamond compact (PDC), hardface, ceramics, carbides, ceramic carbides, cermets, and the like. The space between rotor 302 and mandrel can be filled with a lubricant to reduce friction, inhibit undesired fluid flow, and inhibit corrosion. Suitable lubricants include oils such as mineral oils and synthetic oils and greases such as silicone grease, fluoroether-based grease, and lithium-based grease. One or more O-rings can be positioned between rotor 302 and mandrel 312 to inhibit undesired fluid flow and retain lubricants. Suitable O-rings can be composed of materials such as acrylonitrile-butadiene rubber, hydrogenated acrylonitrile-butadiene rubber, fluorocarbon rubber, perfluoroelastomer, ethylene propylene diene rubber, silicone rubber, fluorosilicone rubber, chloroprene rubber, neoprene rubber, polyester urethane, polyether urethane, natural rubber, polyacrylate rubber, ethylene acrylic, styrene-butadiene rubber, ethylene oxide epichlorodrine rubber, chlorosulfonated polytethylene, butadiene rubber, isoprene rubber, butyl rubber, and the like.

In another embodiment, movement of the mandrel 312 is controlled by a downhole actuator. The actuator can be electrical, mechanical, electromechanical, pneumatic, hydraulic, and the like as known by those of skill in the art. For example, the mandrel 312 can be coupled to a hydraulic or pneumatic piston. In another example, mandrel 312 is coupled with the actuator by a gear assembly, such as a rack and pinion.

Although depicted as a substantially cylindrical in FIGS. 3A-3D, mandrel 312 can be any shape suitable to selectively control the flow of fluid through rotor windows 310*a*-310*d*. For example, mandrel 312 can be or can be replaced by a series of plates or gates mounted on the inside of rotor 302 and configured to effect the selective control described herein.

Figure 4:
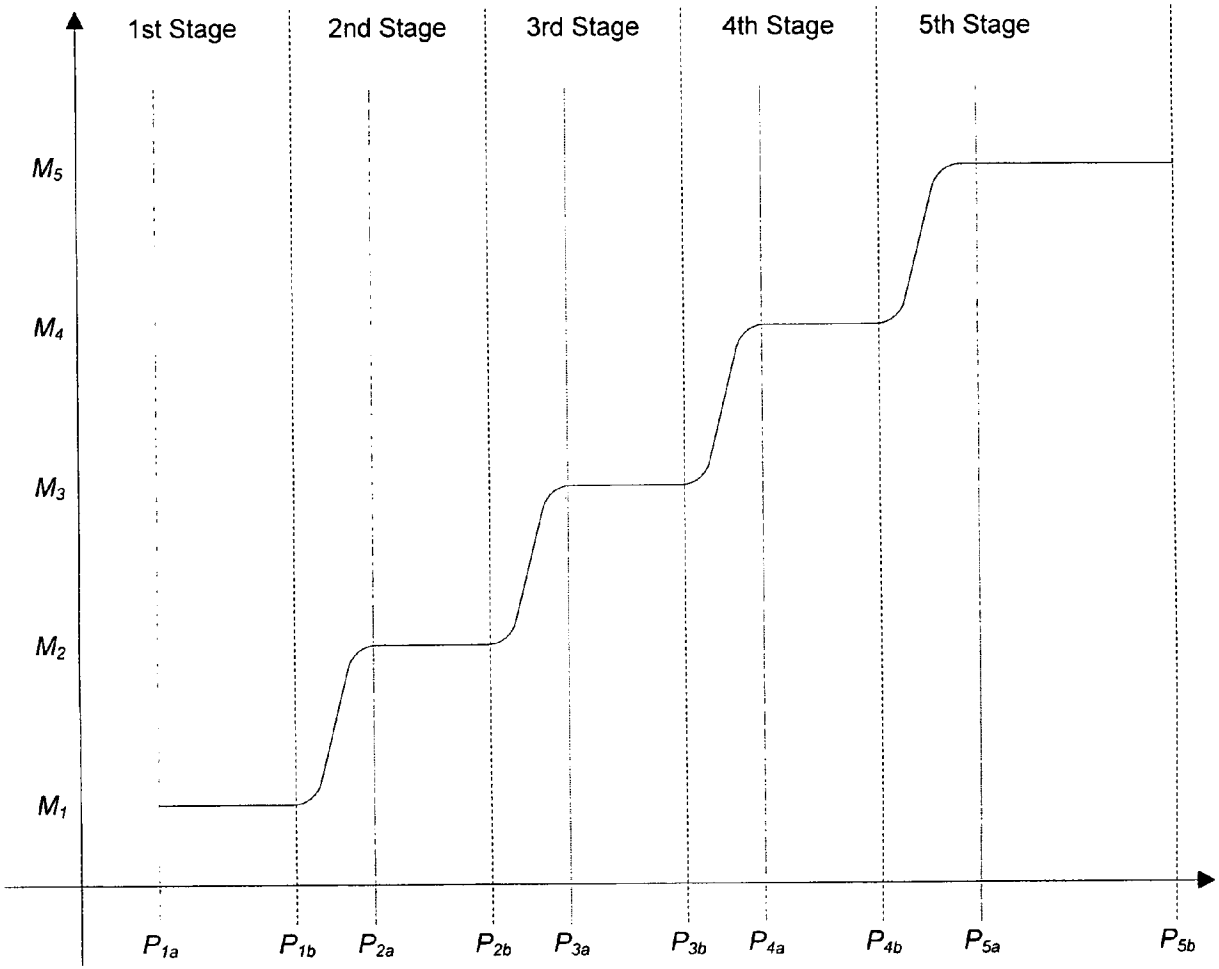
FIG. 4 illustrates the relationship between orifice pressure and mandrel displacement according to one embodiment of the invention.

An example of discrete mandrel movement as discussed herein is depicted in FIG. 4. Mandrel pressure P is represented in the x axis and mandrel displacement M is represented along the y axis. As depicted in FIG. 4, mandrel displacement remains substantially constant between a pressure range within each "stage". That is, mandrel displacement is about $M_1$ between $P_{1a}$ and $P_{1b}$, about $M_2$ between $P_{2a}$ and $P_{2b}$, about $M_3$ between $P_{3a}$ and $P_{3b}$, about $M_4$ between $P_{4a}$ and $P_{4b}$, and about $M_5$ between $P_{5a}$ and $P_{5b}$.

Mandrel movement according to FIG. 4 can be achieved with a series of springs, each spring coupled with a governor configured to limit the travel of the spring. An exemplary arrangement of springs is depicted in FIGS. 5A-E. A simplified cross-section 500 of a rotor 502 (without curves or vanes) and mandrel 504 is depicted. Mandrel 504 is retained within the rotor 502 by a series of springs 506*a-d*. Springs 506*a-d* can, in some embodiments, be connected by plates 508*a-c* by a variety of fastening means such a chemical or mechanical fasteners including welding, brazing, rivets, bolts, screws, nails, chains, and the like.

Figure 5A:
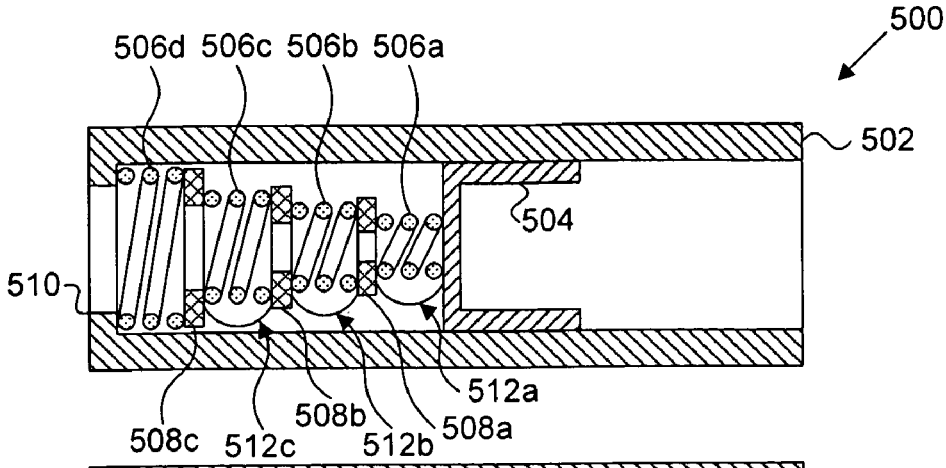
FIGS. 5A-5E illustrate the structure and operation of an series of springs configured to effect discrete mandrel displacement according to one embodiment of the invention.
Figure 5B:
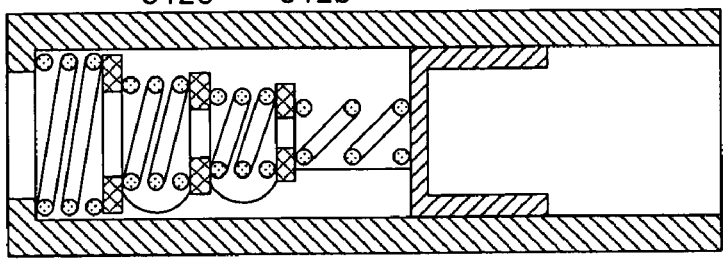

In FIG. 5A, each of the springs 506*a-d* is substantially unextended. In FIG. 5B as the fluid pressure from orifice 510 increases, mandrel 504 is displaced distally and extending spring 506*a*. At a certain point, spring 506*a* reaches a point of maximum extension and does not extend any further. Spring 506*a* can be prevented from further extension by the design of spring 506*a* or by a governor 512*a* such as a cable, chain, or other linkage coupled to mandrel 504 and plate 508*a*.

Figure 5C:
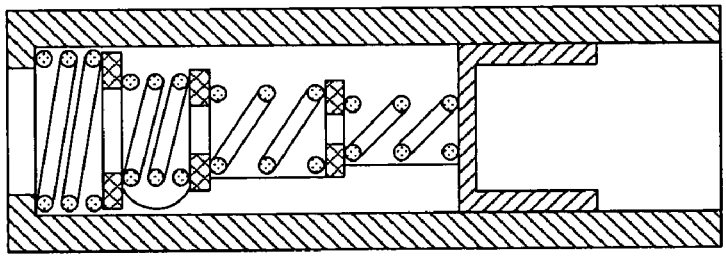
Figure 5D:
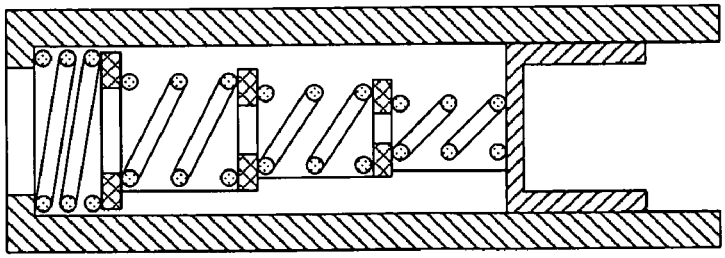
Figure 5E:
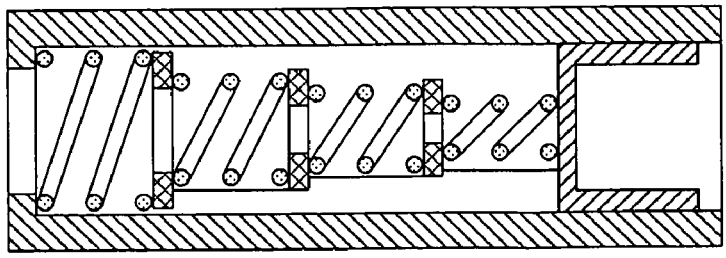

Referring to FIGS. 5C-5E, as the fluid pressure from orifice 510 continues to increase, successive springs 506*b*, 506*c*, 506*d* extend until the maximum extension is released, at which point governor 512*b*, 512*c* can prevent further extension.

Although FIGS. 5A-5E depict a series of compression springs arranged to effect discrete mandrel movement, other springs such as compression springs can be arranged to produce a similar effect. Such an embodiment is depicted in Robert O. Parmley, *Machine Devices & Components* 13-14 (2005).

INCORPORATION BY REFERENCE

All patents, published patent applications, and other references disclosed herein are hereby expressly incorporated by reference in their entireties by reference.

EQUIVALENTS

Those skilled in the art will recognize, or be able to ascertain using no more than routine experimentation, many equivalents of the specific embodiments of the invention described herein. Such equivalents are intended to be encompassed by the following claims.

The invention claimed is:

1. A downhole drilling system comprising:

a downhole motor;

a transmission coupled to the downhole motor; and a drill bit coupled to the transmission, wherein the downhole motor includes:

a stator having a proximal end and a distal end; and a rotor having a proximal end and a distal end, the rotor received coaxially within the stator, wherein the transmission comprises:

a plurality of rotor windows extending through the rotor; and a mandrel having a proximal end and a distal end, the mandrel received coaxially within the rotor, the mandrel having a plurality of mandrel windows, wherein the mandrel is movable to selectively align one or more of the mandrel windows with one or more of the rotor windows, thereby allowing the flow of fluid from between the stator and rotor into the mandrel.

2. The downhole motor of claim 1, wherein the rotor includes an orifice for receiving fluid from the proximal end of the stator.

3. The downhole motor of claim 1, further comprising:

a spring received within the rotor for countering distal movement of the mandrel.

4. The downhole motor of claim 3, wherein the spring is an extension spring located at the proximal end of the rotor.

5. The downhole motor of claim 3, wherein the spring is a compression spring located at the distal end of the rotor.

6. The downhole motor of claim 1, wherein the downhole motor is fed at the proximal end of the stator by pressure from a drill string.

7. The downhole motor of claim 1, wherein the distal end of the mandrel is vented to downstream pressure.

8. The downhole motor of claim 1, wherein the mandrel is initially configured to allow flow of fluid through a most proximal rotor window.

9. The downhole motor of claim 1, wherein the mandrel is configured to only allow fluid flow through one of the plurality of rotor windows.

10. The downhole motor of claim 1, further comprising:

a downhole actuator for controlling the position of the mandrel.

11. The downhole motor of claim 1, wherein the mandrel is configured for discrete actuation, wherein at least one mandrel window is completely aligned with at least one rotor window.

12. The downhole motor of claim 1, further comprising:

a plurality of springs, each spring configured to hold the mandrel so that at least one of the mandrel windows is aligned with at least one of the rotor windows.

13. The downhole motor of claim 1, wherein the fluid is mud.

14. A downhole motor comprising:

a stator having a proximal end and a distal end;

a rotor having a proximal end and a distal end, the rotor received coaxially within the stator, the rotor having a plurality of rotor windows; and a mandrel having a proximal end and a distal end, the mandrel received coaxially within the rotor, the mandrel having a plurality of mandrel windows, wherein the mandrel is movable to selectively align one or more of the mandrel windows with one or more of the rotor windows, thereby allowing the flow of fluid from between the stator and rotor into the mandrel.

15. A method of drilling a borehole in a subsurface formation comprising:

providing a drill string including:

a downhole motor;

a transmission coupled to the downhole motor; and a drill bit coupled to the transmission; and rotating the drill string while flowing a fluid through the drill string to the downhole motor, thereby powering the downhole motor, thereby rotating the transmission and the drill bit, wherein the downhole motor includes:

a stator having a proximal end and a distal end; and a rotor having a proximal end and a distal end, the rotor received coaxially within the stator, wherein the transmission comprises:

a plurality of rotor windows extending through the rotor; and a mandrel having a proximal end and a distal end, the mandrel received coaxially within the rotor, the mandrel having a plurality of mandrel windows, wherein the mandrel is movable to selectively align one or more of the mandrel windows with one or more of the rotor windows, thereby allowing the flow of fluid from between the stator and rotor into the mandrel.

16. The method of claim 15, further comprising:

selectively actuating the mandrel to adjust the torque applied to the bit, wherein selectively actuating the mandrel allows for drilling at the optimum speed.

17. A bottom hole assembly comprising:

a motor having a rotor with a plurality of stages, the motor being powered by a flow of fluid through one or more of the stages;

a first shaft coupled to the motor; and a transmission combined with the motor, the transmission operating to control flow of fluid to a select number of stages of the plurality of stages.

18. The bottom hole assembly of claim 17, wherein the rotor comprises a plurality of rotor windows and the transmission comprises a mandrel having a plurality of mandrel windows which operate in cooperation with the plurality of rotor windows to control flow of fluid to the select number of stages.

19. The bottom hole assembly of claim 17, wherein the transmission comprises a linearly movable member within the rotor.

20. A method of drilling a borehole in a subsurface formation comprising:

providing a drill string coupled to a bottom hole assembly including:

a motor having a rotor with a plurality of stages;

a transmission combined with the motor; and a bit rotated by the combined motor and transmission;

rotating the drill string while flowing a fluid through the drill string to the motor, thereby powering the motor; and selectively actuating the transmission to control flow of the fluid to a desired number of stages of the plurality of stages to maintain a desired rotational speed of the motor.

21. The method of claim 20, wherein actuating the transmission is performed by linearly moving a mandrel positioned within the rotor.

* * * * *